US008179331B1

(12) United States Patent
Sievenpiper

(10) Patent No.: US 8,179,331 B1
(45) Date of Patent: May 15, 2012

(54) FREE-SPACE PHASE SHIFTER HAVING SERIES COUPLED INDUCTIVE-VARIABLE CAPACITANCE DEVICES

(75) Inventor: Daniel Frederic Sievenpiper, Los Angeles, CA (US)

(73) Assignee: HRL Laboratories, LLC, Malibu, CA (US)

( * ) Notice: Subject to any disclaimer, the term of this patent is extended or adjusted under 35 U.S.C. 154(b) by 59 days.

(21) Appl. No.: 12/748,293

(22) Filed: Mar. 26, 2010

Related U.S. Application Data

(62) Division of application No. 11/982,477, filed on Oct. 31, 2007, now Pat. No. 7,719,477.

(51) Int. Cl.
*H01Q 3/26* (2006.01)
*H01Q 3/44* (2006.01)
*H01P 1/18* (2006.01)

(52) U.S. Cl. ..... 343/754; 333/157

(58) Field of Classification Search ..... 333/156, 333/157; 343/754, 778, 783
See application file for complete search history.

(56) References Cited

U.S. PATENT DOCUMENTS 3,790,908 A 2/1974 Burns

*Primary Examiner* — Benny Lee
(74) *Attorney, Agent, or Firm* — Christie, Parker, Hale

(57) ABSTRACT

A method of changing phase of a microwave electromagnetic beam in free space is provided wherein a cascade of device layers is located transverse to a path of the microwave beam. Each of the device layers have one or more columns. Each column has a device combination series-coupled to an adjacent device combination in the column. Each device combination has a first device having inductive characteristics at microwave frequencies and a second device series-coupled to the first device. The second device has at microwave frequencies characteristics of a fixed capacitance in parallel with a variable capacitance. The capacitance of one or more of the second devices is variable to establish a desired phase shift and a desired frequency band edge within a desired frequency pass band.

10 Claims, 17 Drawing Sheets

Free space waveguide model

Equivalent circuit model

Magnitude

Phase

Electrical Specifications @ $T_A$ = +25°C
Gamma 0.75 Hyperabrupt Tuning Varactors
Breakdown Voltage @ 10μA = 20 V minimum
Reverse Current @ 16 V = 100nA maximum
Gamma = 0.68-0.83, VR = 0 to 20 V

| Part Number | Total Capacitance +/-10% | Total Capacitance Ratio | Q Minimum |
|---|---|---|---|
| | $V_R$=4V | $V_R$=0V / $V_R$=20V | $V_R$=4V F=50MHz |
| | (pF) | - | - |
| MA46H070 | 0.5-0.7 | 5.5 | 4500 |

$$n_{eff} = \frac{\omega}{k}$$

$$\emptyset = \frac{2\pi}{\lambda_0} \ell n_{eff}$$

Magnitude

Phase

FREE-SPACE PHASE SHIFTER HAVING SERIES COUPLED INDUCTIVE-VARIABLE CAPACITANCE DEVICES

CROSS-REFERENCE TO RELATED APPLICATION(S)

This application is a divisional of U.S. application Ser. No. 11/982,477, filed Oct. 31, 2007, now issued as U.S. Pat. No. 7,719,477, issued May 18, 2010, the entire disclosure of which is hereby incorporated by reference herein.

BACKGROUND

The present invention relates to phase shifters, and in particular, to phase shifters useable in systems requiring a steerable antenna or an antenna that transmits or receives a modulated signal.

Conventional phase shifters include several classes of devices:

1) Tunable frequency selective surfaces—Tunable frequency selective surfaces provide varying transmission amplitude when the surface is tuned. These structures can also provide a phase shift when they are tuned. However, since this is accompanied by a change in amplitude, they are less useful since it is desirable to have the phase shifter transmit nearly constant amplitude while changing the phase.

2) Tunable impedance surfaces—Tunable impedance surfaces provide a phase shift on reflection. However, reflective phase shifters are problematic for many applications where the platform cannot permit the geometry required for an external feed which would be required for a reflective phase shifter.

3) Quasi-optical devices—Quasi optical devices typically provide amplification to a signal passing through them, but could also be designed to provide a phase shift. However, such amplification involves active devices needed for amplification, adding more system complexity.

Each class of conventional phase shifters has further difficulties. For example, the tunable frequency selective surface typically occupies a single layer, with that layer creating a frequency-dependent amplitude variation on the wave passing through it. Multi-layer frequency selective surfaces have been studied, but each layer has the same filtering effect and it would be problematic as to how to build up a multi-layer structure where each layer produces a progressive phase shift. For the tunable impedance surfaces, it would be problematic as to how to convert a reflective phase shifter into a transmissive phase shifter. For the quasi-optical devices, these typically also occupy a single layer, so the same problems as for the frequency selective surfaces applies here.

SUMMARY OF THE INVENTION

The present invention provides a new way of changing the phase of a microwave beam in free space. It allows one to create a steerable antenna using a free space feed, which eliminates the loss and weight associated with a conventional corporate feed structure. A novel aspect of the invention is the free space phase shifting device. This is a lightweight, extended structure that is many wavelengths in size, which accepts a plane wave at one side, and radiates a phase-shifted version of the same plane wave from the other side. In some implementations, it includes a biasing scheme that allows the amount of phase shift to be varied across the area of the device. By programming the phase shifter to produce an arbitrary phase function across its area, one can create nearly any desired radiation pattern, including steering the beam to any desired angle, or producing multiple beams. It can also be used to modulate the wave passing through it, to eliminate the need for a separate phase modulator.

Large antennas with a free space feed may include steerable reflectarrays or tunable impedance surfaces. Embodiments of the present invention provide advantages over such structures for certain applications because they do not require the geometry necessary for a reflective beam steering apparatus. For example, the phase shifting device can be embedded in the skin of an aircraft, with the source located inside the aircraft and radiating through the phase shifting device to the outside of the aircraft. With a reflective phase shifter, the source would need to be located outside the aircraft, thus degrading the aerodynamics of the aircraft.

The present invention can be used in any product requiring an antenna that transmits or receives a modulated signal. It could also be used for large inflatable aerostat structures, or any other platform in which a large aperture steerable antenna would be useful.

In one exemplary embodiment a method of changing phase of a microwave electromagnetic beam in free space is provided wherein a first device having inductive characteristics at microwave frequencies is located transverse to a path of the microwave electromagnetic beam. A second device having at the microwave frequencies characteristics of a fixed capacitance in parallel with a variable capacitance is series-coupled to a periphery of the first device. The capacitance of the second device is variable to establish a desired phase shift and a desired frequency band edge within a desired frequency pass band.

In another exemplary embodiment a method of changing phase of a microwave electromagnetic beam in free space is provided wherein a cascade of device layers are locating transverse to a path of the microwave beam, each of the device layers having: a first device having inductive characteristics at microwave frequencies and a second device series-coupled to the first device, the second device having at the microwave frequencies characteristics of a fixed capacitance in parallel with a variable capacitance. The capacitance of one or more of the second devices is variable to establish a desired phase shift and a desired frequency band edge within a desired frequency pass band.

In a further exemplary embodiment a method of changing phase of a microwave electromagnetic beam in free space is provided wherein a cascade of device layers is located transverse to a path of the microwave beam, each of the device layers having: one or more columns, each column having a device combination series-coupled to an adjacent device combination in the column, each device combination having: a first device having inductive characteristics at microwave frequencies and a second device series-coupled to the first device, the second device having at the microwave frequencies characteristics of a fixed capacitance in parallel with a variable capacitance. The capacitance of one or more of the second devices is variable to establish a desired phase shift and a desired frequency band edge within a desired frequency pass band.

The first device may be a metal strip.

The second device may be selected from the group consisting of a varactor diode, a micromechanical varactor or a voltage variable dielectric.

The capacitance of the second device may be varied by varying a voltage applied to the second device.

The second device may be connected to an adjacent second device in the column by a resistive device.

The resistive device may be a resistive wire.

The second device may be connected by a resistive wire to an adjacent second device in an adjacent column.

The cascade of device layers may include an input device layer and an output device layer, the capacitance of the second device of the input device layer and the capacitance of the second device of the output device layer being one half of the capacitance of the second device of interior device layers.

When using a structure having vertical metal strips with varactor diodes between the metal strips, in an exemplary embodiment operating in an L-band waveguide there may be four metal strips mounted in a vertical column with a varactor diode between each metal strip. There may be six of these vertical columns aligned across the waveguide forming a layer of vertical columns and there may be six layers of the six vertical columns mounted into the waveguide transmission path. One DC bias voltage would be applied to each of the vertical columns with the metal waveguide forming the DC ground.

DETAILED DESCRIPTION OF THE INVENTION

Figure 1A:
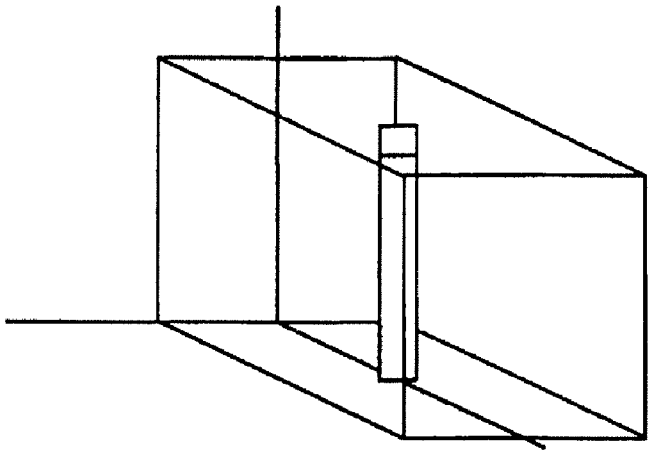
FIG. 1A shows a free space waveguide model using a commercial electromagnetic solver.
Figure 1B:
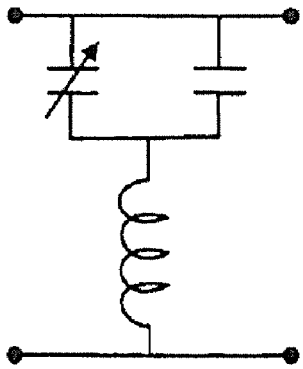
FIG. 1B shows an equivalent circuit model for the simulated model of FIG. 1A.

The free-space phase shifter in accordance with the present invention may be depicted using electromagnetic simulations as shown in FIG. 1A (as developed from a commercial finite element method solver for electromagnetic structures, and, more specifically, developed from the HFSS™ commercial electromagnetic solver software from Ansoft Corporation) and lumped equivalent circuit models as shown in FIG. 1B. In more detail, FIG. 1A shows a free space waveguide model using a commercial electromagnetic solver.

An electromagnetic simulation is compared with a lumped element circuit model since complicated lumped element circuits can be developed based upon an accurate representation of the electromagnetic simulation. The electromagnetic simulation provides a block section of free space waveguide with electric and magnetic boundary conditions on the boundaries of the block and input and output ports in the direction of wave transmission. Magnitude and phase of transmission (S21) and reflection (S11) of one unit cell is calculated. The calculations are compared to the lumped element model and the values of the lumped element model inductor and capacitors are adjusted to accurately represent the electromagnetic simulation results.

Figure 2A:
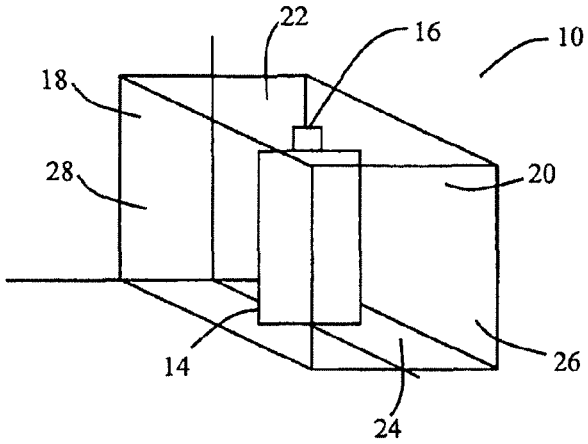
FIGS. 2A, 2B and 2C show a single unit cell of a free-space phase shifter modeled using a commercial electromagnetic solver (FIG. 2A), along with its magnitude (FIG. 2B) and phase (FIG. 2C) plots.
Figure 2B:
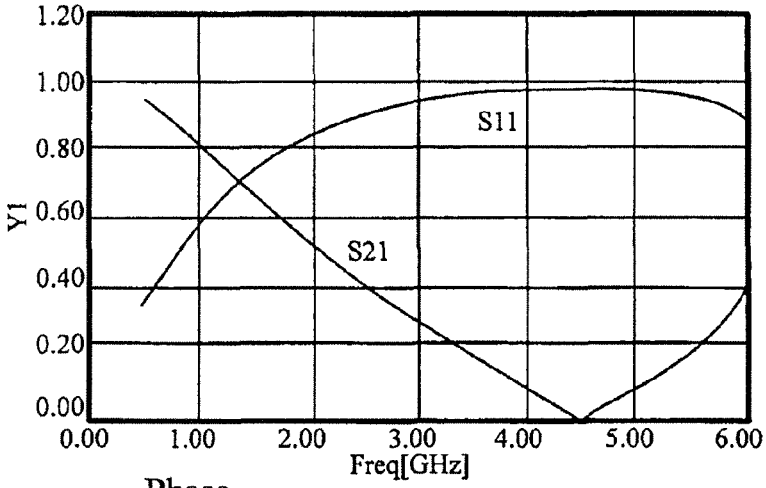
Figure 2C:
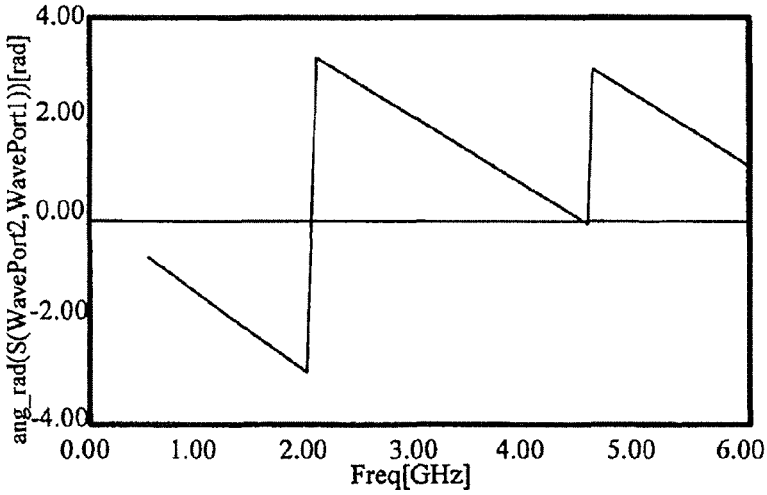

As seen in FIG. 2A, single unit cell 10 is simulated, and the magnitude (of S11 and S21 in Y1 versus Freq[GHz]) and phase (in ang_rad(S(WavePort2, WavePort1))[Rad] versus Freq[GHz]) of the transmission and reflection coefficients are shown in FIGS. 2B and 2C, respectively. This is compared to those of an equivalent lumped circuit model 12 as shown in FIG. 3A along with its magnitude (in frequency[GHz]) and phase (in frequency[GHz]) as seen in FIGS. 3B and 3C, respectively.

Figure 4:
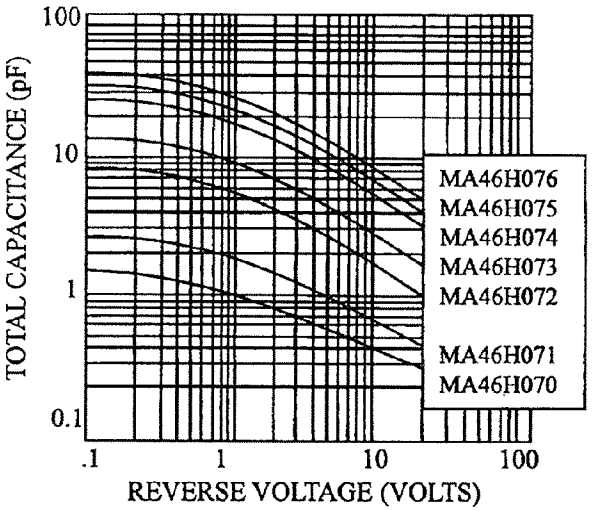
FIG. 4 shows the characteristics of an exemplary group of varactors which can be used to implement the present invention.
Figure 4:
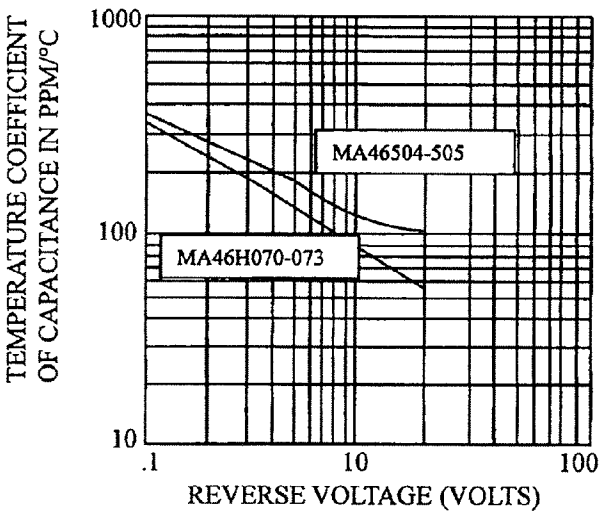
Figure 4:
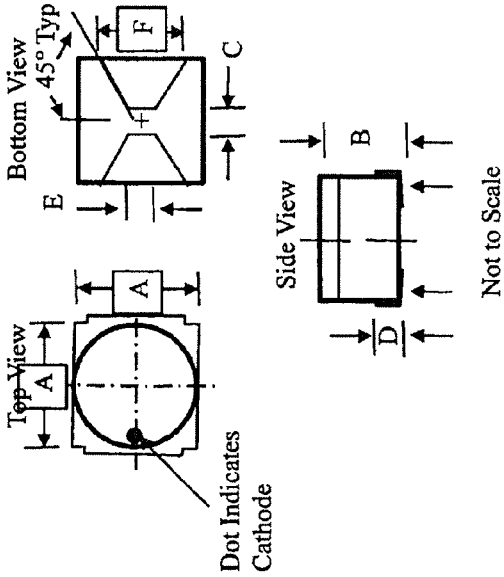
Figure 5A:
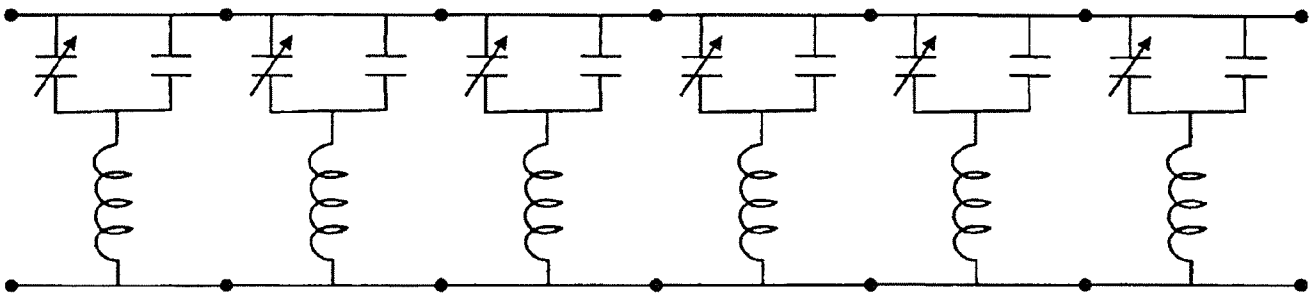
FIGS. 5A, 5B and 5C provide a lumped circuit model of a six cell embodiment, along with its magnitude and phase plots.
Figure 5B:
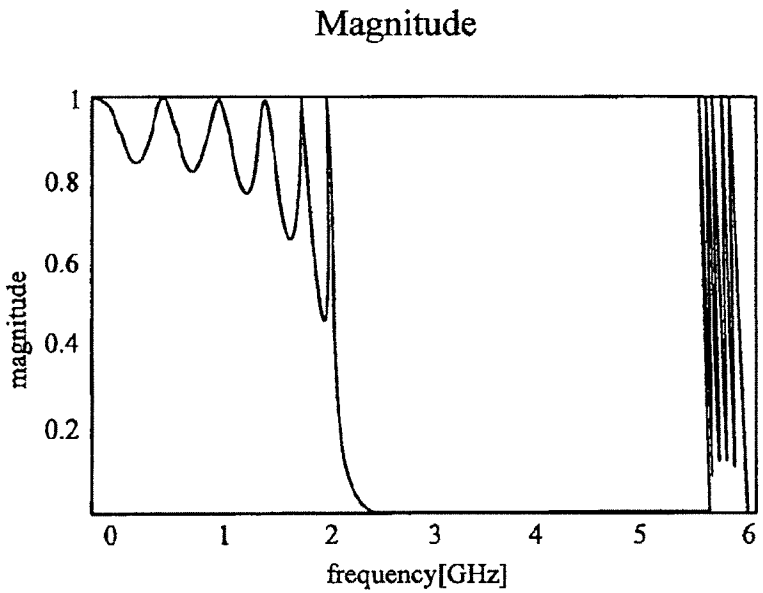
Figure 5C:
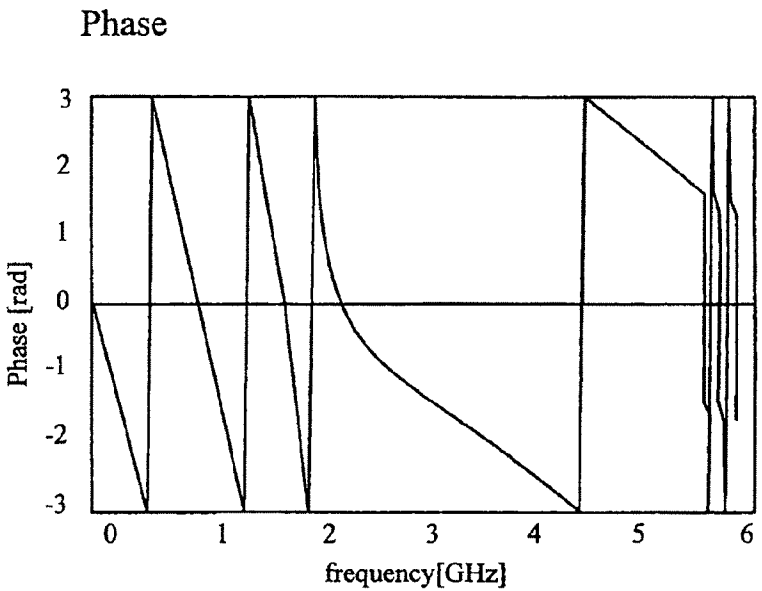

In FIG. 2A, single unit cell 10 includes metal strip 14, and varactor 16, which is modeled as an impedance sheet. Varactor 16 could be a diode, or it could be a microelectromechanical varactor, or a voltage variable dielectric device such as barium strontium titanate. FIG. 4 shows the characteristics of an exemplary group of varactors which can be used to implement the present invention. In more detail and for exemplarily purposes, FIG. 4 shows the electrical specifications at $T_A$=25° C., such as breakdown voltage at 10 μA=20V minimum, reverse current at 16V=100 nA maximum, gamma range 0.68-0.83, VR=0 to 20 V, cathode location, total capacitance (pF) versus reverse voltage (volts), and temperature coefficient of capacitance in PPM/° C. versus reverse voltage (volts) of a group of gamma 0.75 hyperabrupt tuning varactors which can be utilized to implement an embodiment of the present invention. In even more detail and for exemplary purposes, FIG. 4 shows a varactor top view (with dimensions A), a varactor bottom view (with dimensions C, E, and F), a varactor side view (with dimensions B and D), a varactor part number and its characteristic values, a total capacitance (pF) versus reverse voltage (volts) graph of several exemplary varactors, and a temperature coefficient of capacitance in PPM/° C. versus reverse voltage (volts) of two exemplary varactors. In addition, as shown in FIG. 2A, the two vertical walls 18, 20 of the simulation volume are magnetic conductors, and the two horizontal walls 22, 24 are electric conductors, so that the space models a section of free space for a vertically polarized plane wave. The front (output) 26 and back (input) 28 of the simulation volume are specified as ports.

Figure 3A:
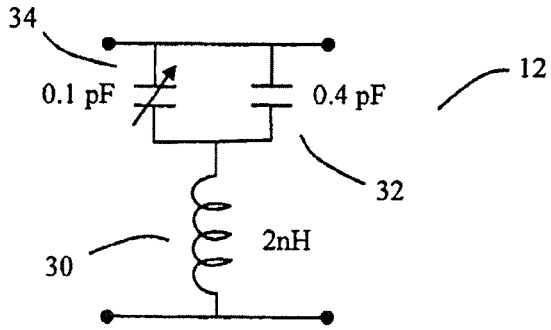
FIGS. 3A, 3B and 3C show a lumped circuit model (FIG. 3A), along with its magnitude (FIG. 3B) and phase (FIG. 3C) plots.
Figure 3B:
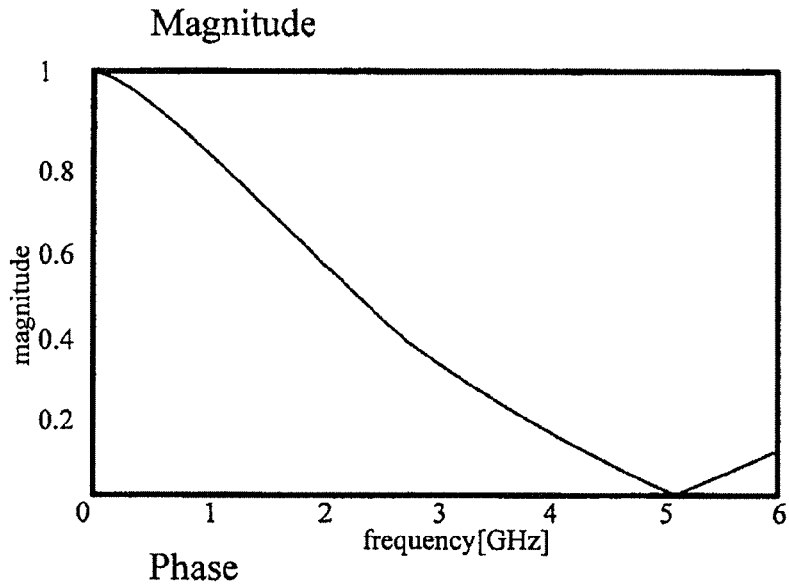
Figure 3C:
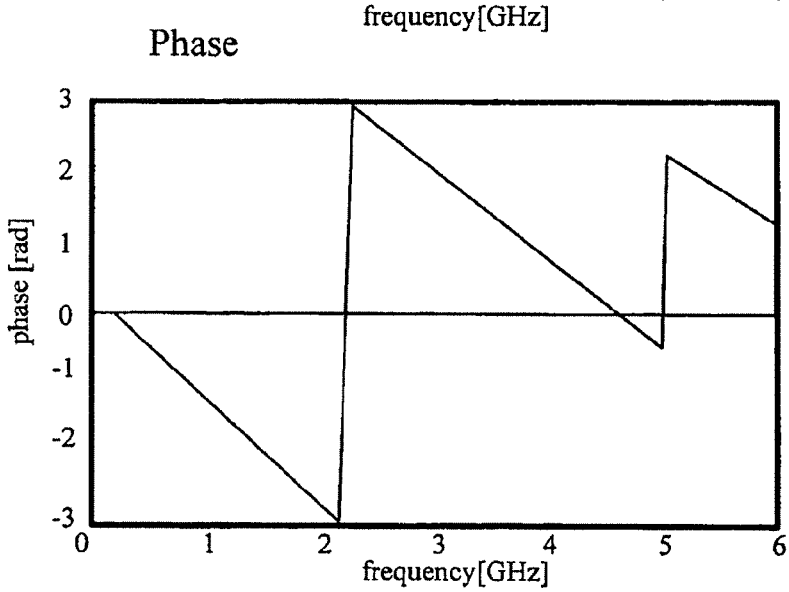

In the lumped circuit model of FIG. 3A its circuit topology accurately models the scattering parameters of the unit cell simulation. The structure which was simulated was a one-inch square unit cell. The metal strip was one-half inch wide and 0.9 inches long. The varactor was 0.1 inches long by 0.1 inches wide. In this case, the lumped circuit model which accurately reproduces the scattering properties of the metal strip and the varactor is represented in FIG. 3A by inductor 30 (2nH) in series with two capacitors 32, 34, both in parallel with each other, one being a fixed capacitor 32 (0.4 pF) and one being a tunable capacitor 34 (0.1 pF).

The lumped circuit model can be used to build up complicated arrangements of the simple unit cell, and accurately predict their performance without having to perform long and memory-intensive simulations of a complicated electromagnetic structure. The transmission matrix model is used, which is well-known to those familiar with the art of microwave circuits. The transmission matrix of the lumped circuit is:

$$\begin{vmatrix} 1 & 0 \\ Y & 0 \end{vmatrix}$$

where Y is the admittance of the circuit shown in FIG. 1B. The transmission matrix of a section of free space of length 1 is:

$$\begin{vmatrix} \mathrm{Cos}(Bl) & jZoSin(Bl) \\ jYo(Bl) & \mathrm{Cos}(Bl) \end{vmatrix}$$

where $B=2\pi/\lambda$, $\lambda$ is the free space wavelength, $Y_0$ is the admittance of free space, and $Z_o$ is the impedance of free space. These matrices can be cascaded in any arrangement desired to calculate the cascaded combination of multiple unit cells. This lumped circuit model allows many variations of very complex structures to be tested without requiring numerous long and memory-intensive electromagnetic simulations. After arriving at the desired transmission behavior, the final structure is simulated with the HFSS™ electromagnetic solver software.

Figure 6A:
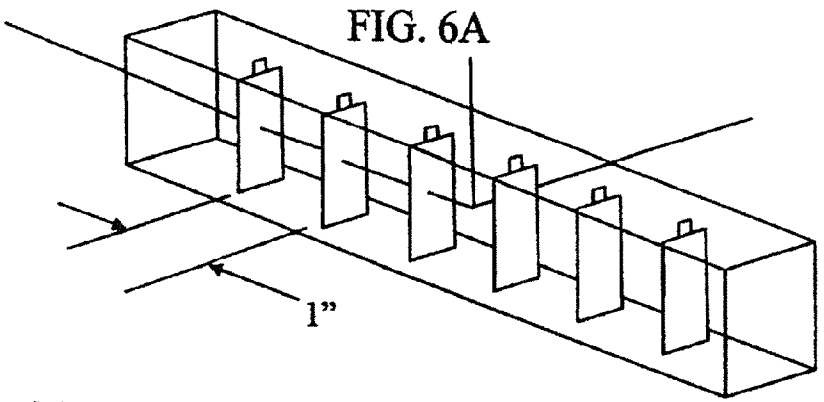
FIGS. 6A, 6B and 6C provide an simulation model of a six cell embodiment (FIG. 6A), along with its magnitude (FIG. 6B) and phase (FIG. 6C) plots.

FIGS. 5A, 5B, 5C and 6A, 6B, 6C provide a comparison between a lumped circuit model and the electromagnetic simulation for a cascade of six unit cells separated by one inch (1") of free space between each layer as shown in FIG. 6A. In an exemplary embodiment the six unit cells structure cascaded together provide magnitude and phase plots as respectively set forth in FIGS. 5B, 5C and 6B, 6C. The six layer structure allows for a sharp band edge between low transmission and high transmission and having a phase slope that gets steeper as the band edge approaches. When moving the band edge back and forth by tuning the varactors allows for the use of the structure as a phase shifter.

Figure 6B:
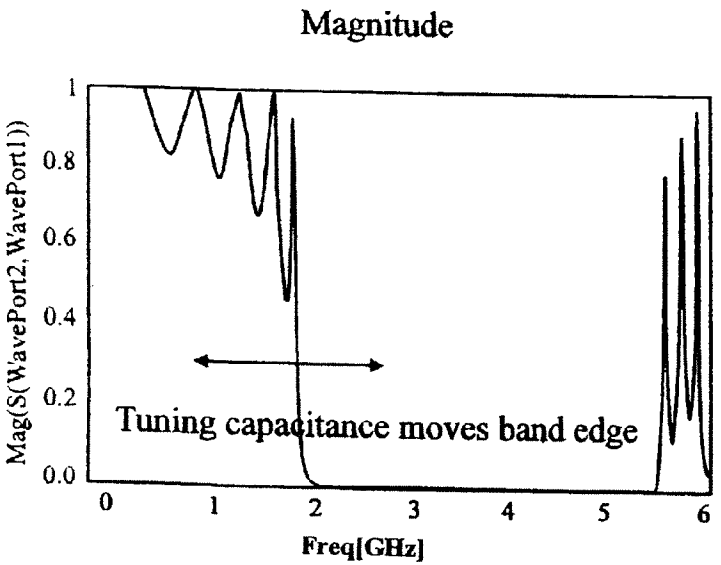
Figure 6C:
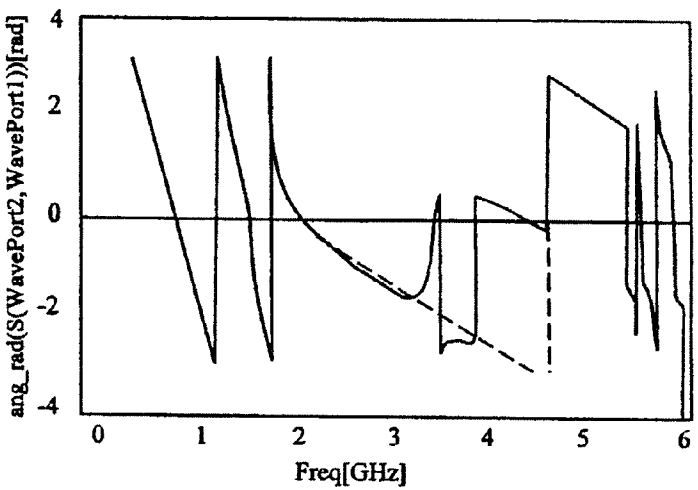

In the exemplary embodiment shown in FIGS. 6A, 6B (in Mag(S(WavePort2, WavePort1)) versus Freq[GHz]) and 6C (in ang_rad(S(WavePort2, WavePort1))[rad] versus Freq [GHz]) having the cascade of 6 unit cells the resulting transmission behavior shows a pass band below about 2 GHz, followed by a stop band, and a second pass band at about 5.5 GHz. Within the lower pass band, the phase displays the typically sawtooth function that one would expect for a delay line. The slope of the phase is a function of both the length of the delay line and the effective refractive index (phase velocity) of the delay line. By varying the capacitance of the varactors, the frequency of the lower pass band edge is changed as denoted by the arrow in FIG. 6B, as is the slope of the phase curve within the pass band.

Figure 7:
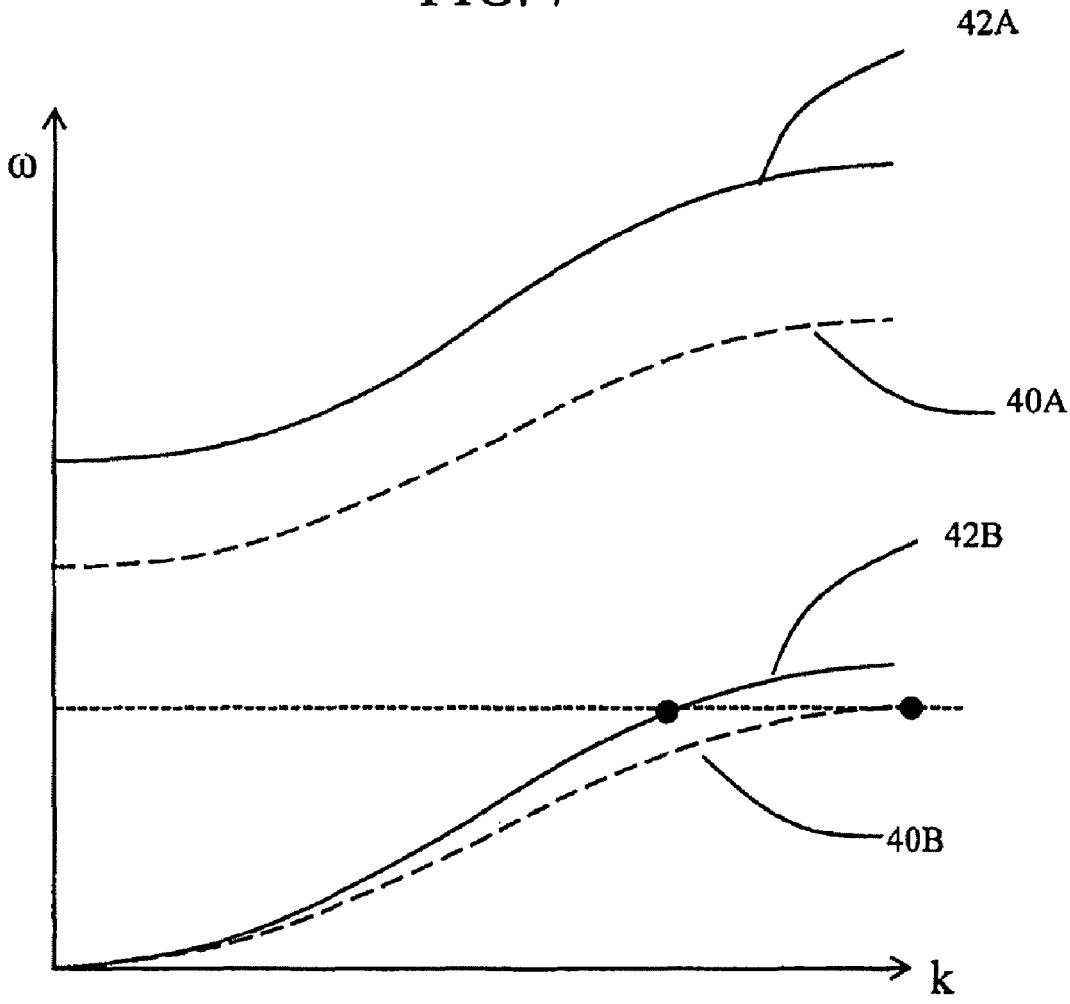
FIG. 7 shows a model of the dispersion diagram of the phase shifter.

The cascade of unit cells may be considered as an effective dielectric, in which the effective dielectric constant is varied by tuning the varactors. This structure behaves as a phase shifter. FIG. 7 shows a model of the dispersion diagram of the phase shifter. At a given frequency, the refractive index is determined by the wave vector at that frequency, as dictated by the dispersion curve.

Referring to FIG. 7, when the varactors are in a high capacitance state, the dispersion diagram is shown as the hatched curves 40A, 40B. When they are in a low capacitance state, the dispersion diagram is shown as the solid curves 42A, 42B. The effective index of refraction is given by $n_{eff}=\omega/k$. The total phase through the structure is given by: $\Phi=2\pi/\lambda_0 l\, n_{eff}$, where l is the length of the structure. The transmission band curve (solid) lines 42A, 42B when the varactor is in a low capacitance state moves to a band curve (hatched) 40A, 40B with the varactor in a high capacitance state. At a single frequency $\omega$, k, the wave vector, has a difference which represents the phase difference. In essence, as the capacitance moves up and down at a fix frequency, the wave vector, and, in turn, the phase, changes. As the capacitance of the varactors is increased, the dispersion curve shifts from the solid line to the hatched line, and the wave vector changes. This changes the effective refractive index, and thus changes the total phase through a fixed length of the device.

Figure 8A:
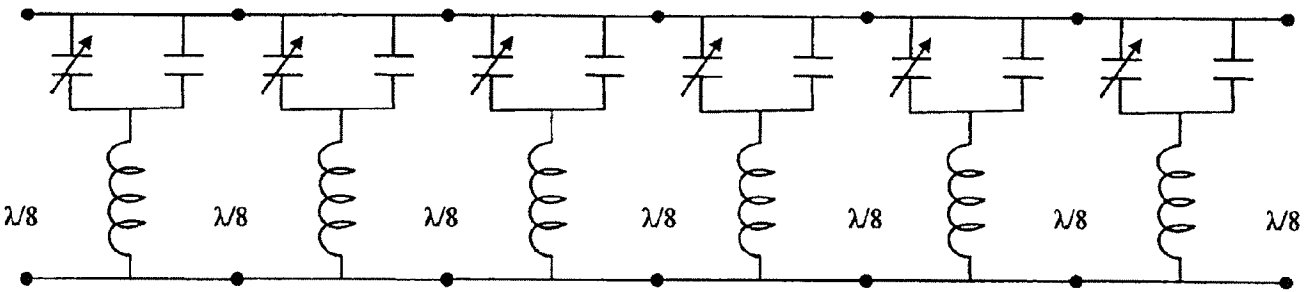
FIGS. 8A, 8B and 8C provide a simulation model of a six cell embodiment with cells spaced λ/8 apart (FIG. 8A), along with its magnitude (FIG. 8B) and phase (FIG. 8C) plots.
Figure 8B:
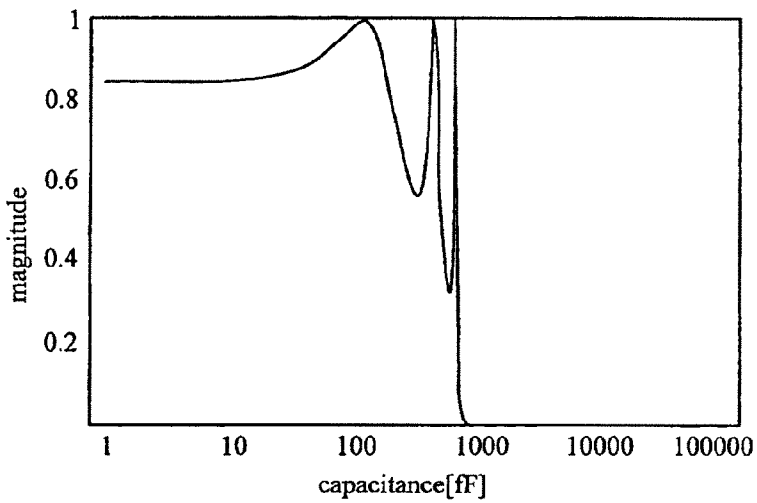
Figure 8C:
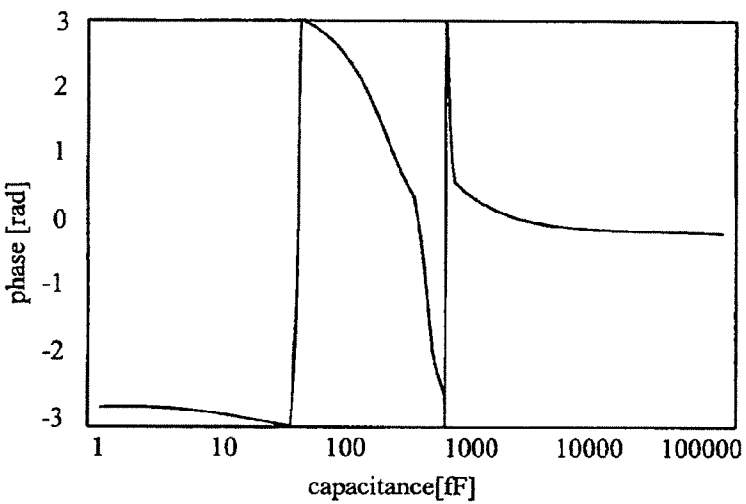
Figure 9A:
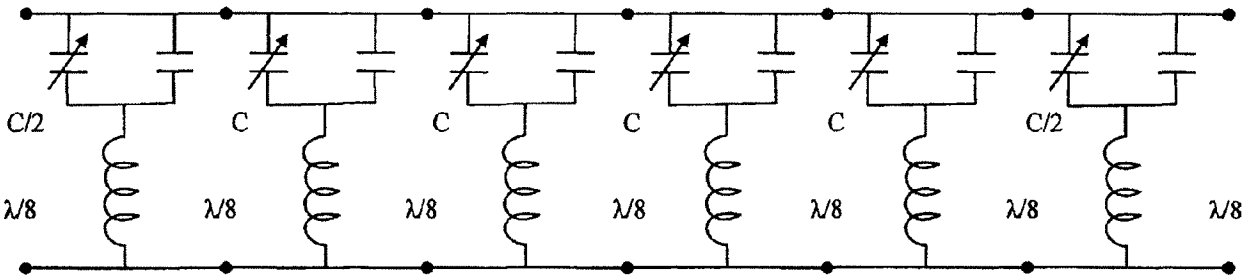
FIGS. 9A, 9B and 9C provide a simulation model of a six cell embodiment with cells spaced λ/8 apart and having input and output cells at half capacitance (FIG. 9A), along with its magnitude (FIG. 9B) and phase (FIG. 9C) plots.

Referring to FIGS. 8A, 8B and 8C, using the lumped circuit model, the magnitude (FIG. 8B) and phase (FIG. 8C) of the transmitted wave can be calculated for various values of capacitance, as the voltage on the varactor is swept over its operating range. FIG. 8A shows a six-cell phase shifter spaced apart by $\lambda/8$. In FIGS. 8B and 8C its magnitude and phase as a function of capacitance is respectively depicted. Transmission magnitude is high up to a certain point and then drops off much like the frequency band edge. The transmission magnitude has dips which correspond to reflections at the input and output surfaces of the structure. The capacitance of the first and last layer of the structure can be changed to help minimize the reflections, resulting in less dips. FIG. 9A shows a six-cell phase shifter spaced apart by $\lambda/8$ and that the varactor capacitance of the first and last layer being set at half (½) the varactor capacitance (C) of the interior layers.

Over the range of about 100 to 1000 fF, the phase covers about $2\pi$. Over this same range, the magnitude shows significant ripples, as the device is operating near the edge of the pass band. These magnitude ripples are reduced when the capacitance of the two end structures is one-half that of the rest of the devices.

Figure 9B:
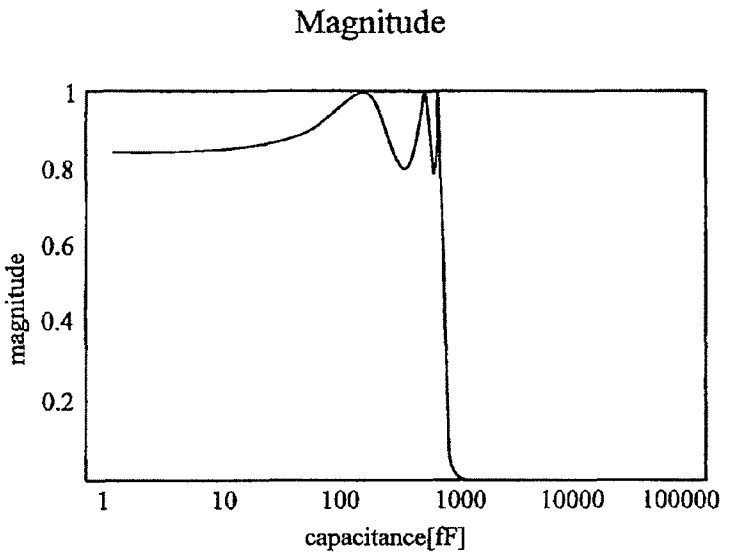

The data shown in FIGS. 5B, 5C and 6B, 6C, respectively shows the magnitude and phase as a function of frequency, but it does not explain how the structure can be used as a phase shifter. Again, using the lumped circuit model, we can sweep the capacitance of the varactors, thus simulating how they would behave if the reverse bias voltage were swept. Such an exercise would take a large number of time-consuming simulations using an electromagnetic solver, but the calculation is rapid when using the lumped circuit model. FIGS. 8B, 8C and 9B (in magnitude versus capacitance), 9C (in phase versus capacitance) show the transmission magnitude and phase of the wave transmitted through the structure as the capacitance is varied over a wide range. The phase varies over about $2\pi$ for a capacitance range of about 100 to 1000 fF, which is within the range of commercially available varactors. The magnitude shows significant variations over this range because the device is operating near the edge of its pass band. This problem can be reduced by apodization, in which, as mentioned above, the capacitance of the end unit cells is reduced to half the value of the rest of the unit cells. This can be considered as a kind of impedance matching layer, or antireflection layer. Other, more complex reflection reducing mechanisms can also be used, and these are known to those skilled in the art of filter design.

Figure 10A:
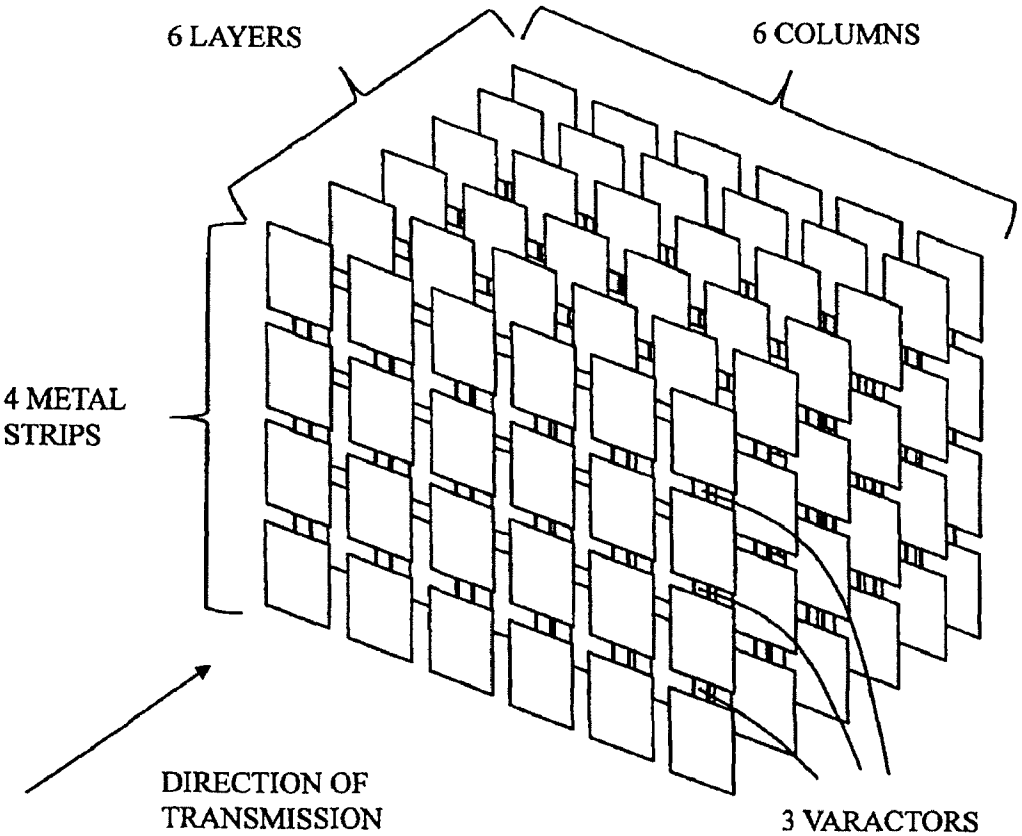
FIGS. 10A and 10B show an exemplary embodiment a section of the phase shifter (FIG. 10A) fitted inside an L-band (WR650) waveguide (FIG. 10B).
Figure 10B:
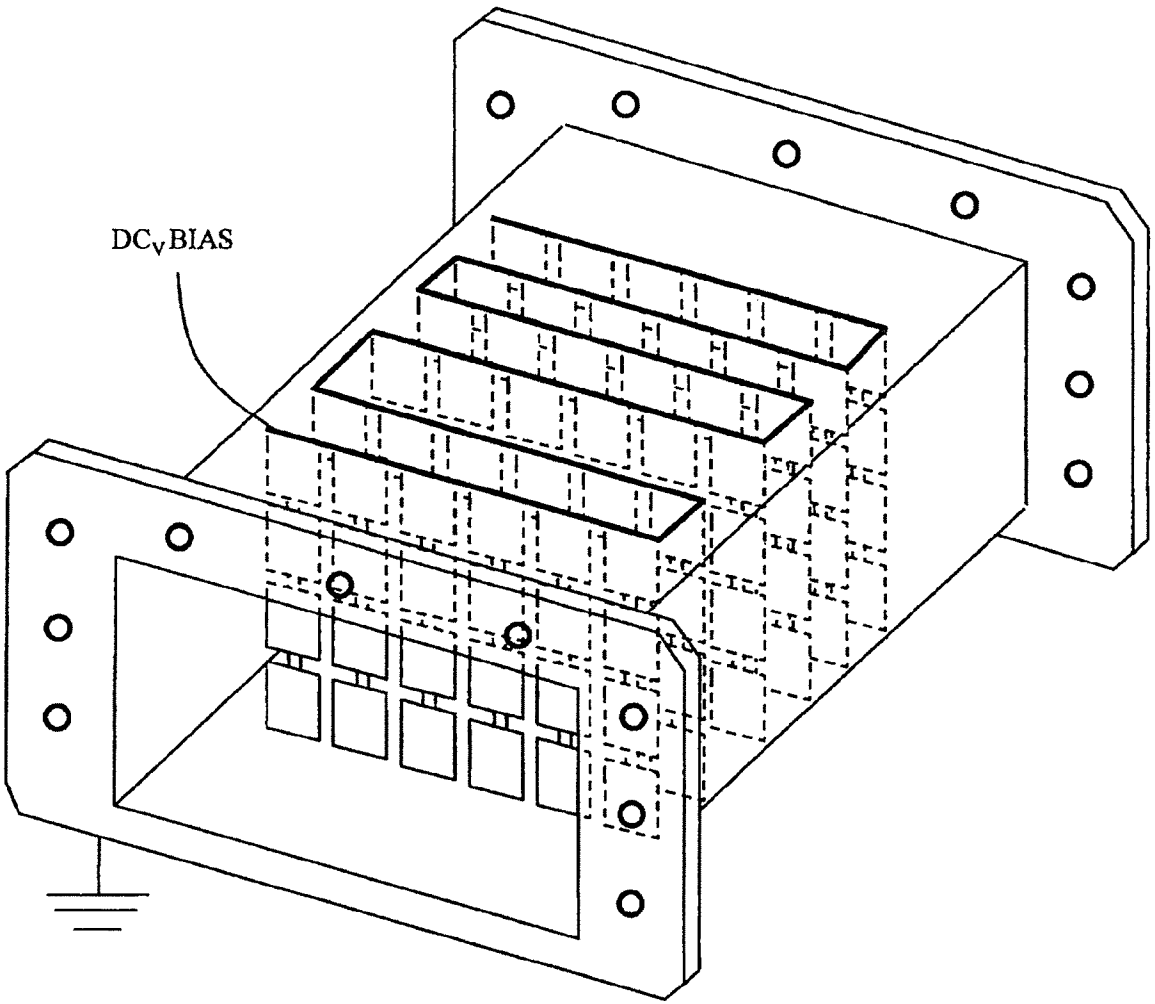

Referring to FIGS. 10A, 10B, in an exemplary embodiment a section of the phase shifter can be fitted inside an L-band (WR650) waveguide. The varactor-metal strip array structure shown in FIG. 10A consists of six layers in the direction of transmission, and six columns fit within the width of the waveguide. Four metal strips fit within the height of the waveguide. Each column contains three varactors, and when located within the waveguide they are biased in series DC,BIAS as seen in FIG. 10B. The top of each strip extends through the top of the waveguide and the bottom of each strip is attached to the bottom of the waveguide using silver epoxy. The exposed tops of all of the strips are soldered together with a single wire, which is attached to a bias voltage. The varactors operate over a range of 0 to 20 volts. Since this embodiment uses 3 varactors in series for each strip, a bias voltage of 0 to 60 volts is applied.

Figure 11A:
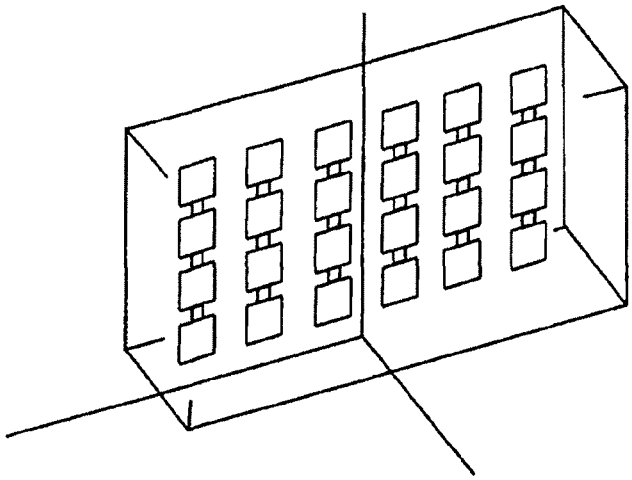
FIGS. 11A, 11B and 11C provide a simulation model of a six cell embodiment (FIG. 11A), along with its magnitude (FIG. 11B) and phase (FIG. 11C) plots over a narrow bandwidth.
Figure 11B:
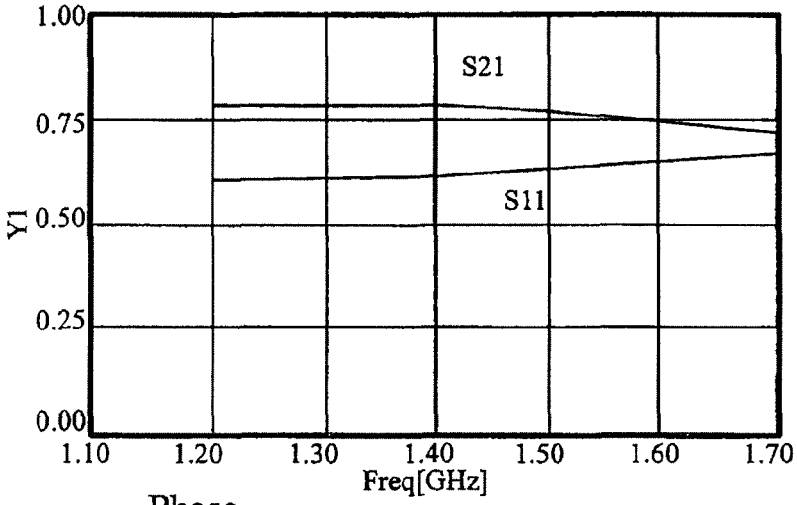
Figure 11C:
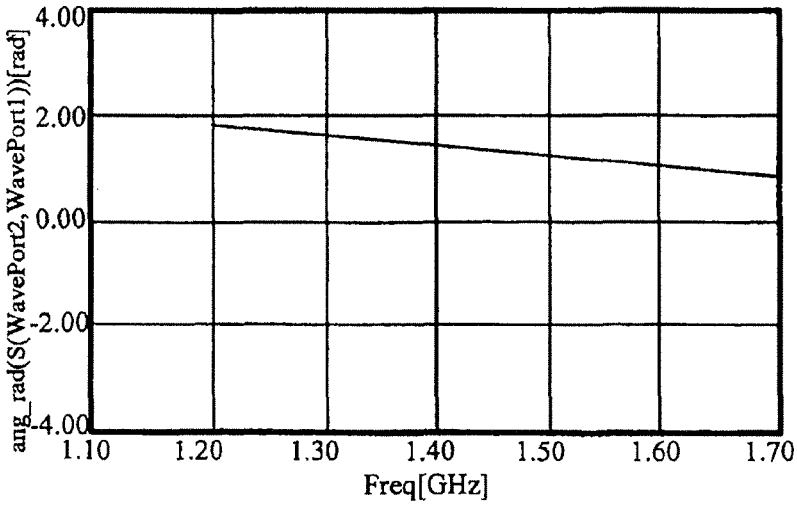

FIG. 11A shows a simulation having a single layer of a six vertical column array and FIGS. 11B, 11C, respectively show its magnitude (of S11 and S21 in Y1 versus Freq[GHz]) and phase (in ang_rad(S(WavePort2, WavePort1))[Rad] versus Freq[GHz]) over a narrow frequency band for the WR650 waveguide. An exemplary phase shifter embodiment consists of 6 layers of the six vertical column array as shown in FIGS. 10A, 10B.

The transmission magnitude and phase over frequency can be assessed as the voltage applied to the varactor is increased from 0 to 60V DC (each varactor in the column of four metal strips receiving 0 to 20 V DC). As the voltage applied to the varactors increases, the band edge (magnitude dropoff) increases in frequency. Also, the phase shifts with increasing voltage. So, for a fixed frequency, by changing the applied voltage a phase shift is realizable. Given a large grid of the metal strip-varactor array, the phase of an incoming wave can be adjusted uniformly or the voltages of different regions of the large gird are varied to provide for beam steering.

Figure 12A:
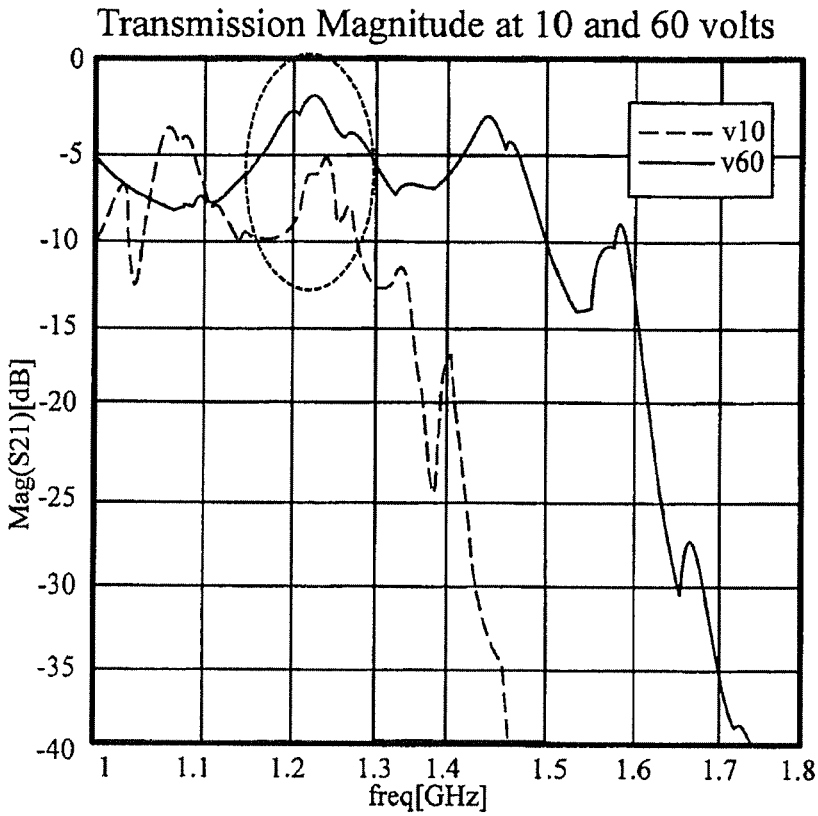
FIGS. 12A, 12B, 12C and 12D, respectively show transmission magnitude, phase, phase difference and total power not absorbed as a function of frequency for two bias voltages.
Figure 12B:
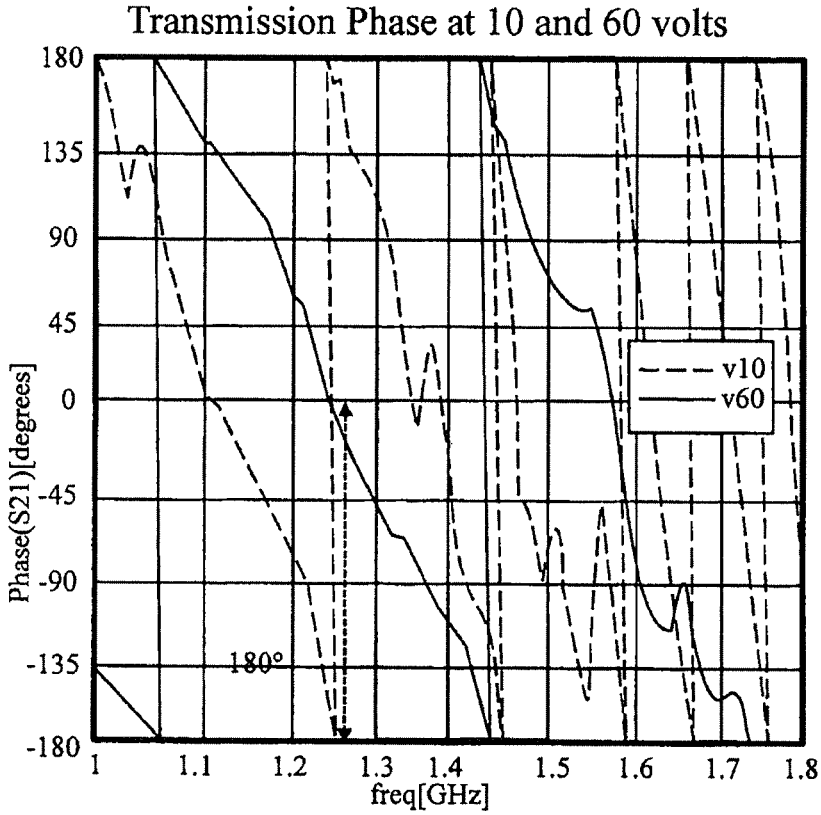

The transmission magnitude and phase for two different states of the bias voltage (i.e. 10 and 60 volts) are respectively shown in FIG. 12A (of 10 volts (v10) and 60 volts (v60) in Mag(S21)[dB] versus freq[GHz]), and FIG. 12B (of 10 volts (v10) and 60 volts (v60) in Phase(S21)[degrees] versus freq [GHz]). The magnitude data shows a drop off at higher frequencies, as expected, and the frequency of the edge of the pass band changes with the applied bias voltage, as expected. The magnitude data also shows ripples, as expected. No effort to reduce the ripples (as described with regard to FIGS. 9A, 9B) was attempted in this embodiment, but that technique could be applied to this structure. The phase curves for the two bias states are separated by roughly 180 degrees as shown in FIG. 12B. A greater phase difference could be achieved by using varactors with a wider tuning range, or by using more layers. A structure with 12 layers would achieve 360 degrees of phase shift, and could be used as a beam steering device. For applications where the phase shifter is to be used as a modulator, one can take advantage of the fact that the ripples in the magnitude plot can be designed to fall at certain frequencies. For this example, the peaks in the magnitude ripples coincide at about 1.25 GHz as shown by the dotted oval. The phase difference between the two states is about 180 degrees at this frequency. Thus, this device could be used as a binary modulator for a binary phase shift keying (BPSK) communication system at that frequency.

Figure 12C:
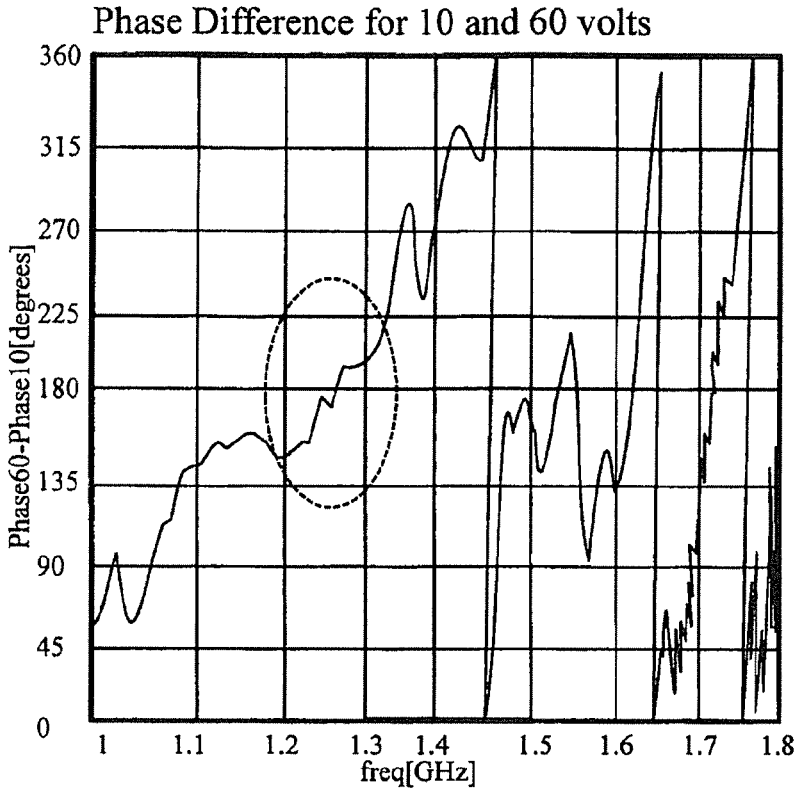

In FIG. 12C (in phase60-phase10[degrees] versus freq [GHz]), there is shown the phase difference for 10 and 60 volts between the two curves of FIGS. 12A and 12B as a function of frequency as shown by the dotted arrows. It should be noted that the phase difference varies with frequency and suggests characteristics of the bandwidth of the structure, namely, the phase tolerance would provide for a defined practical bandwidth.

Figure 12D:
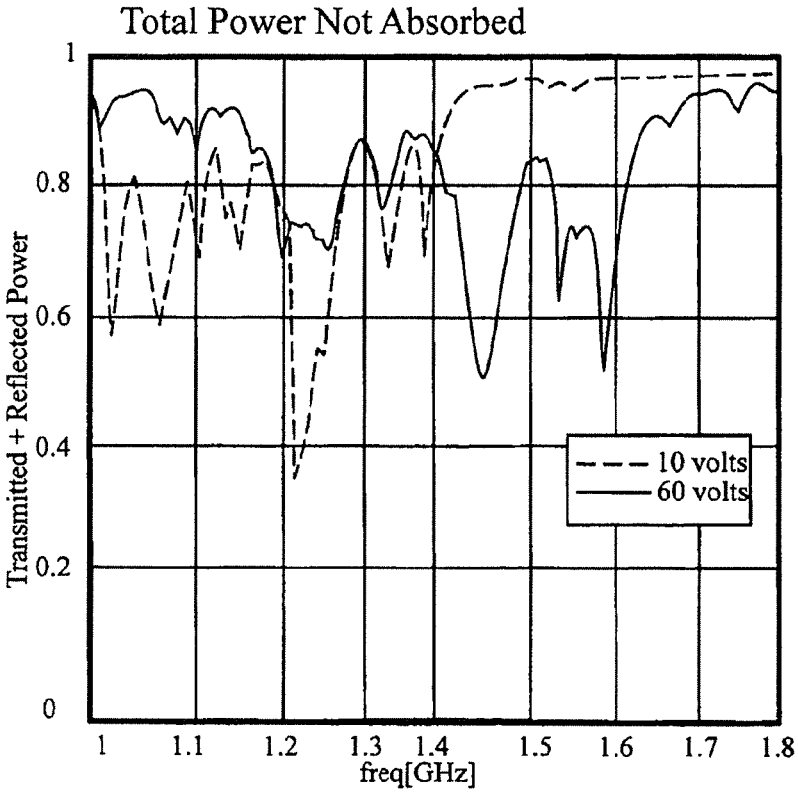

The exemplary embodiment has a bandwidth of about 200 MHz. This was the range over which the phase difference between the two states (i.e. 10 and 60 volts) was roughly 180 degrees. For the two bias states (i.e. 10 and 60 volts) shown in FIGS. 12A, 12B, 12C this occurred at roughly 1.25 GHz as indicated by the circled region in FIG. 12C. However, nearly any phase difference could be achieved over a wide range of frequencies by changing the two bias states. FIG. 12D (of 10 volts and 60 volts in transmitted+Reflected Power versus freq[GHz]) shows the total power that is not absorbed into the structure in both bias states. The fact that the total transmitted and reflected power is close to 100% indicates that the structure is low loss. The fact that the transmitted power is not close to 100% indicates that a large amount of power is being reflected. This is likely due to scattering by nonuniformities in the structure, and could be improved by paying careful attention to the selection and calibration of the varactors to ensure that the structure is as uniform as possible.

Figure 13A:
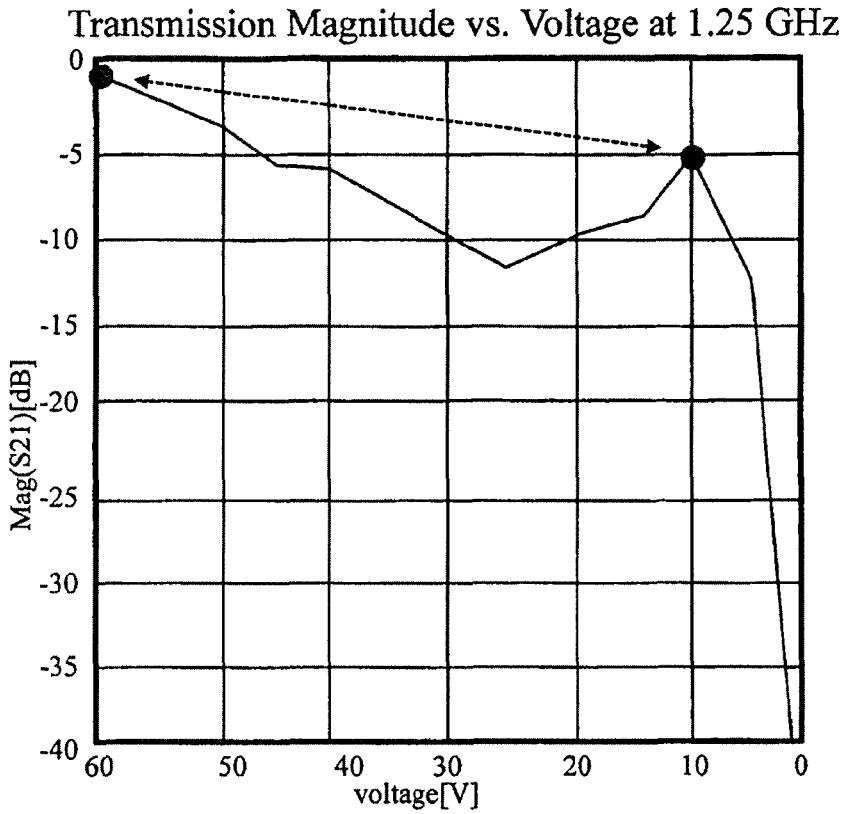
FIGS. 13A and 13B, respectively show transmission magnitude and phase at 1.25 GHz as a function of voltage.
Figure 13B:
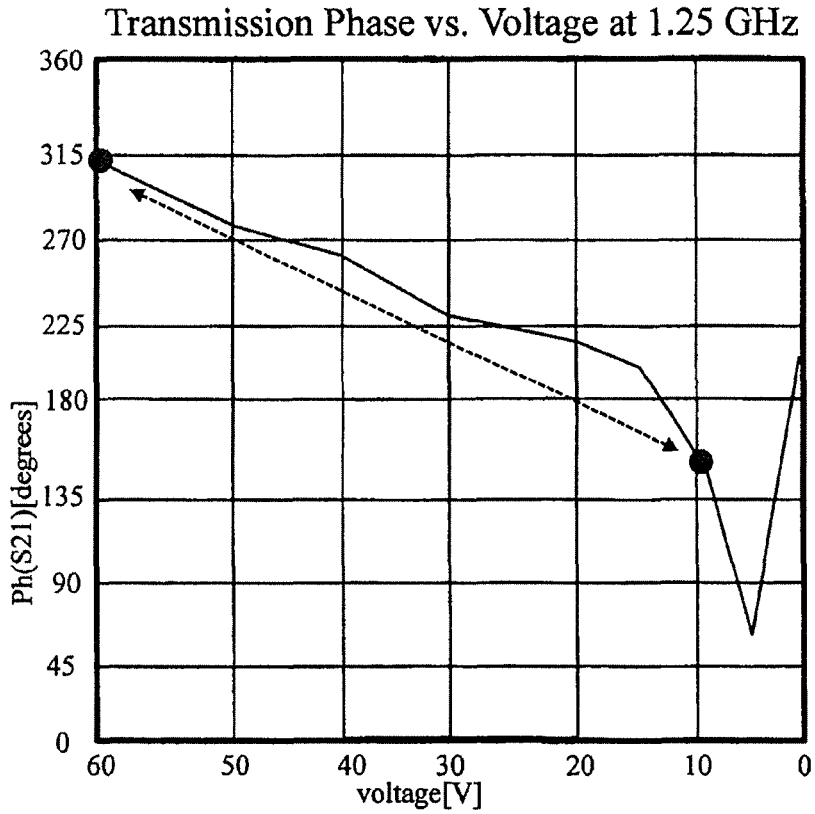

As noted above, the structure can be used as a BPSK modulator by switching between two states in which the transmission phase differs by 180 degrees. The fact that the peaks in the transmission magnitude can be designed to correspond to the frequency where this phase difference occurs can be used to obtain the highest overall transmission for the phase shifter. This is illustrated in FIG. 13A (in Mag(S21) [dB] versus voltage[V]), and FIG. 13B (in ph(S21)[degrees] versus voltage[V]), which respectively show the transmission magnitude and phase at 1.25 GHz as a function of bias voltage. As can be seen in FIG. 13A the structure does not provide for significant loss of transmission magnitude when the voltage varies from 60V to 10V.

The voltage is switched between 10 and 60 volts, which correspond to the peaks in the transmission magnitude. These also correspond to phase states that differ by 180 degrees. If the transitions are rapid, the phase shifter spends very little time in states where the transmission magnitude is low.

Figure 14A:
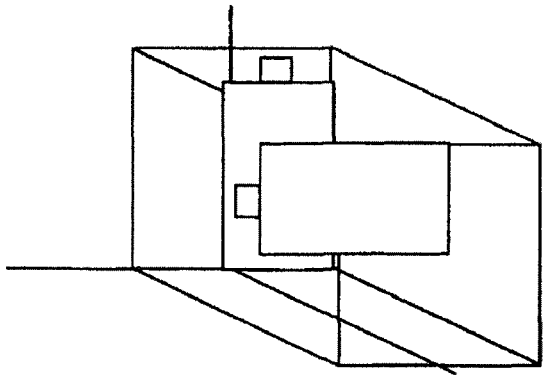
FIGS. 14A, 14B and 14C show a show a single unit cell of a free-space phase shifter with adjacent varactor-metal strip combinations oriented 90° apart (FIG. 14A), along with its magnitude (FIG. 14B) and phase (FIG. 14C) plots.
Figure 14B:
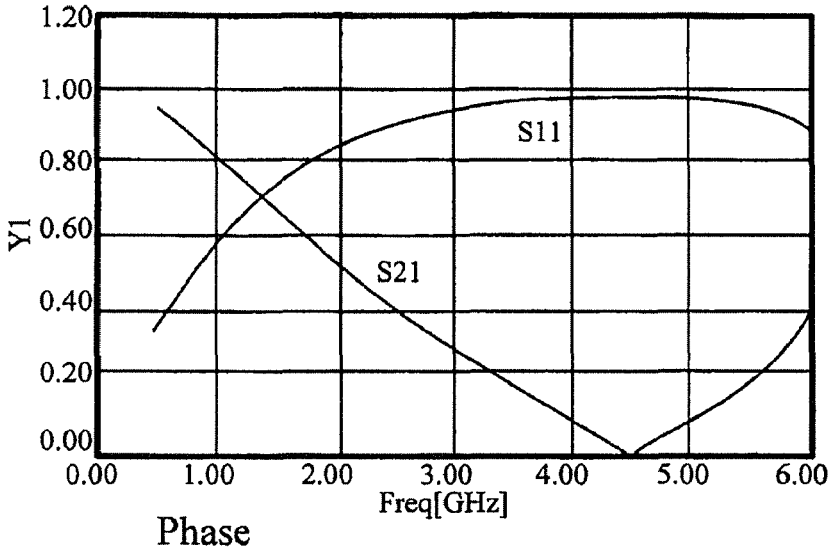
Figure 14C:
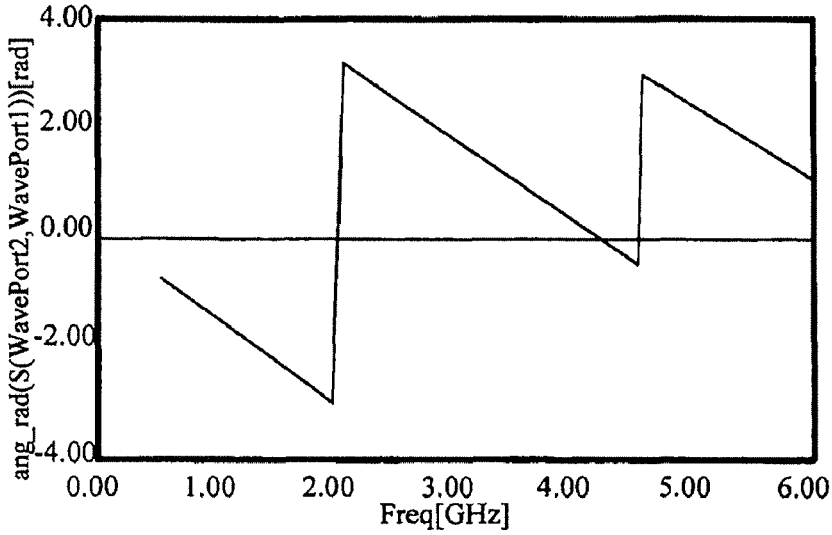

Until now, only structures that operate on a vertically polarized plane wave have been described. However, a similar structure could be used on a plane wave of arbitrary polarization, including any orientation of linear polarization, or even circular polarization. This is done by including a second layer oriented in the direction perpendicular to the first layer. This second layer contains strips and varactors just like the first layer, and they are biased in the same way. FIG. 14A shows a simulation of a single unit cell of a structure containing strips and varactors oriented in both directions, i.e., 90° apart. The fact that the magnitude and phase plots (in frequency[GHz]) of FIG. 14B (of S11 and S21 in Y1 versus Freq[GHz]), and FIG. 14C (in ang_rad(SWavePort, WavePort))[Rad] versus Freq[GHz], respectively are very similar to those in FIGS. 2B, 2C indicates that the second layer has no effect on the vertical polarization. Since both layers effectively operate independently, they can be used to control the two orthogonal polarizations independently, and they can be used together to control any arbitrary polarization.

Figure 15A:
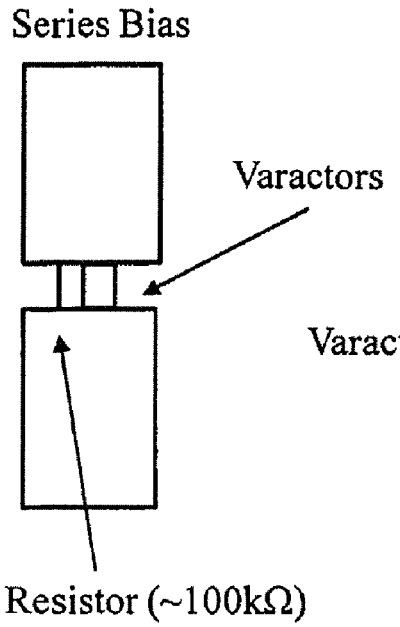
FIGS. 15A and 15B, respectively show series and parallel bias configurations for the varactor-metal strip structures.
Figure 15B:
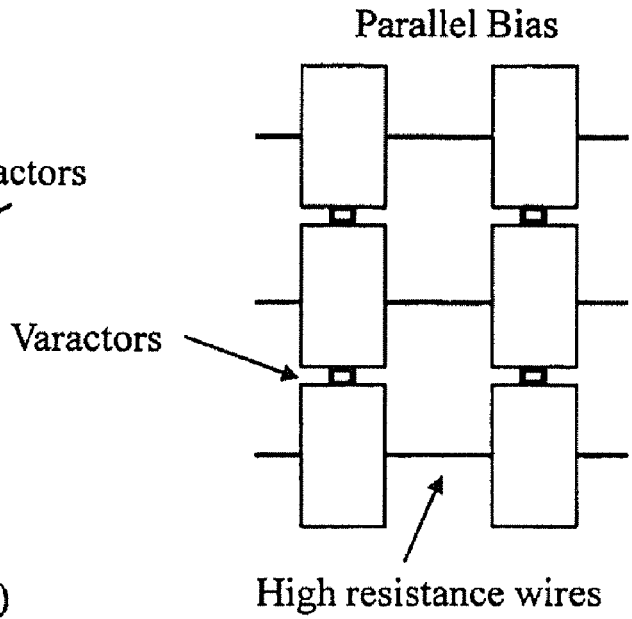

Another aspect of the present invention is the biasing scheme. Because the varactors are nonlinear devices, any variations among them can tend to be amplified when a voltage bias is applied to a string of varactors in series. In order to reduce variations in the bias conditions of all the varactors, two different biasing schemes can be used. FIG. 15A shows a series bias, and FIG. 15B shows a parallel bias. These consist of high value resistors (FIG. 15A) or resistive wires (FIG. 15B) that are arranged between the metal strips. The resistors have high enough value that they have negligible effect on the electromagnetic waves, but they have low enough value that they are lower resistance than the reverse bias resistance of the varactors. A resistor value close to 100 kΩ (FIG. 15A) would be acceptable for many applications. These resistors or resistive wires maintain a constant voltage drop across all of the varactors.

Since varactors can have some variance in their properties (e.g., variance in their resistance) or can even fail, both the series bias configuration or the parallel bias configuration, or even a combination of both the series and parallel configurations, can be implemented to remedy the varactor variance/failure situation. The series bias configuration having a 100 kΩ resistor in parallel with a 0.5M-5MΩ varactor between the adjacent metal strips in the column helps with the variation in resistance by dominating the DC resistance of the pair and provides equal voltage drop across each of the varactors in the column. The parallel bias configuration helps in situations where a varactor is damaged or fails, such that DC voltage can be distributed to other columns in the chain even if there is an open circuit resulting for the damaged or failed varactor. Having high resistance wires interconnecting the metal strips, the resistivity of the wires will not affect the microwave propagation through the configuration while still carrying the voltage to the other columns.

The biasing can also be used to implement the beam steering function. By applying different bias voltages to each strip, or to each resistive wire, the transmission phase will vary across the area of the phase shifter. Using different bias voltages on different strips can be used for steering in the horizontal plane, while different biases on different orthogonal resistive wires can be used to steer in the horizontal plane, for a vertically polarized plane wave. Using these two methods together, one can steer a wave of arbitrary polarization to an arbitrary angle. An added benefit of the parallel bias method is that one can orient each layer of varactors in the opposite direction. Thus, the voltages on each wire can alternate, keeping the highest required voltage to a minimum, rather than requiring that each wire have progressively higher voltages.

Figure 9C:
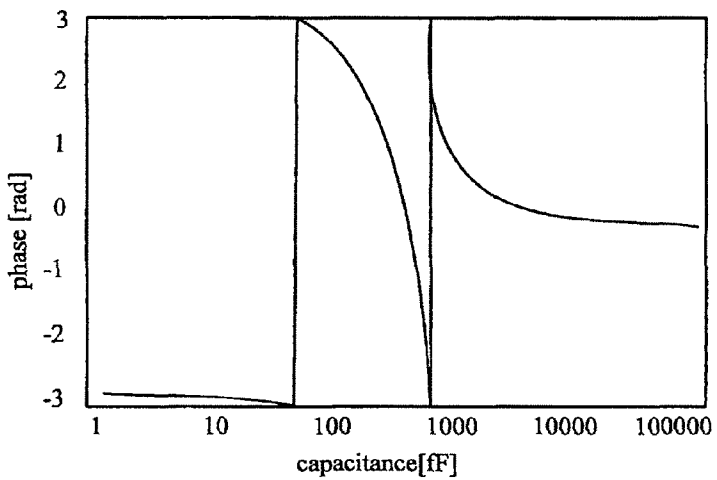
Figure 16A:
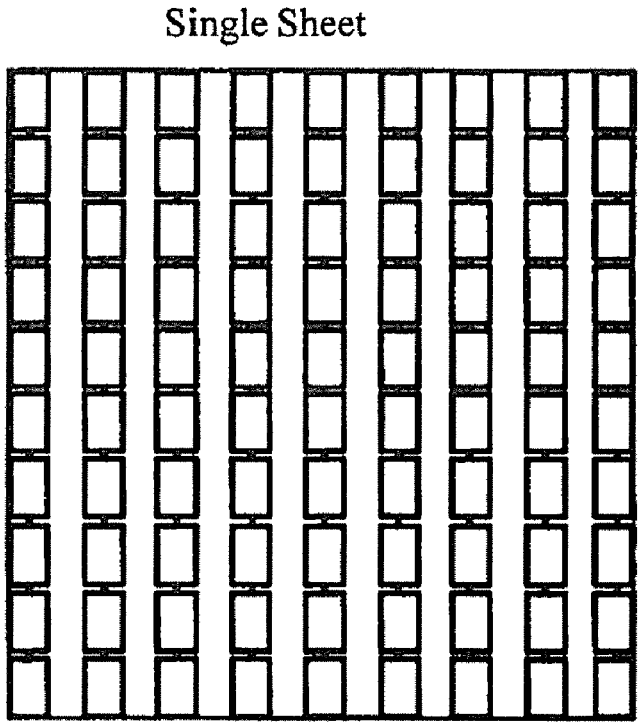
FIGS. 16A and 16B, respectively show a single sheet and stack of sheets of an array of varactor-metal strip structures.
Figure 16B:
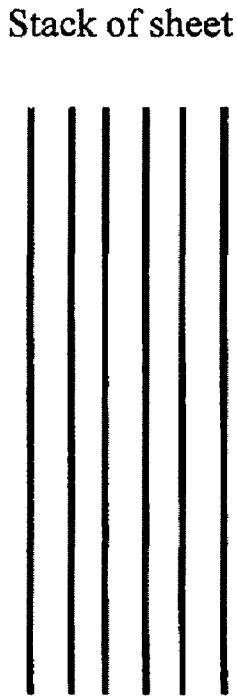

Although an embodiment to verify the concept behind the present invention were conducted inside a waveguide, the primary idea of the present invention is to use these structures to change the phase of a wave in free space. Thus, the phase shifter consists of an extended sheet having many strips and varactors. The entire structure would be many wavelengths wide—as wide as the aperture desired for the antenna. The overall structure of the free-space phase shifter is shown in FIG. 16A. A single sheet contains many metal strips, each containing a series of varactors. The sheets are stacked together with spaces between them. They can be stacked in alternating polarizations, using the concept described with regard to FIGS. 14A, 14B, 14C. Six sheets are shown in FIG. 16B, but any number can be used. Apodization can be used to reduce reflections, as described with regard to FIGS. 9A, 9B, 9C.

The single sheet of FIG. 16A (e.g., a thin 0.001-005 Kapton sheet) would be situated perpendicular to the wave transmission path. The metal strips would be layered on the sheets much like printed circuit lines, for example, ½ oz-1 oz copper per square foot. The single sheet as shown in FIG. 16A, or stacks of sheets as shown in FIG. 16B would be held in tension to be separated from each other, such as at ⅛λ, and could then be located in front of an aperture, or otherwise in the path of an antenna beam, for phase shifting an incoming wave front.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A free space phase shifter, comprising:

a cascade of device layers located transverse to a path of the microwave beam, each of the device layers having:

a first device having inductive characteristics at microwave frequencies; and a second device series-coupled to the first device, the second device having, at the microwave frequencies, characteristics of a fixed capacitance in parallel with a variable capacitance;

wherein capacitance of one or more of the second devices is variable and configured to establish a desired phase shift and a desired frequency band edge within a desired frequency pass band.

2. The free space phase shifter of claim 1, wherein each one of the first devices is a metal strip.

3. The free space phase shifter of claim 1, wherein the cascade of device layers includes an input device layer and an output device layer, the capacitance of the second device of the input device layer and the capacitance of the second device of the output device layer being one half of the capacitance of the second device of an interior layer of the cascade of device layers.

4. The free space phase shifter of claim 1, wherein each one of the second devices is selected from the group consisting of a varactor diode, a micromechanical varactor and a voltage variable dielectric.

5. The free space phase shifter of claim 4, wherein the capacitance of the one or more second device is varied by varying a voltage applied to the one or more second devices.

6. A method of changing phase of a microwave electromagnetic beam in free space, comprising:

locating transverse to a path of the microwave beam a cascade of device layers, each of the device layers having:

a first device having inductive characteristics at microwave frequencies; and a second device series-coupled to the first device, the second device having, at the microwave frequencies, characteristics of a fixed capacitance in parallel with a variable capacitance; and varying the capacitance of one or more of the second devices to establish a desired phase shift and a desired frequency band edge within a desired frequency pass band.

7. The method of claim 6, wherein each one of the second devices is selected from the group consisting of a varactor diode, a micromechanical varactor or a voltage variable dielectric.

8. The method of claim 7, wherein the capacitance of the one or more second devices is varied by varying a voltage applied to the one or more second devices.

9. The method of claim 6, wherein the cascade of device layers comprise an input device layer and an output device layer, the capacitance of the second device of the input device layer and the capacitance of the second device of the output device layer being one half of the capacitance of the second device of an interior layer of the cascade of device layers.

10. The method of claim 6, wherein each one of the first devices is a metal strip.

* * * * *